US007156487B2

(12) United States Patent
Chou et al.

(10) Patent No.: US 7,156,487 B2
(45) Date of Patent: Jan. 2, 2007

(54) MICROFLUIDIC PUMP DRIVEN BY THERMOACOUSTIC EFFECT

(75) Inventors: Ya-Wen Chou, Tainan (TW); Meen-Dau Hoo, Taichung (TW); Chih-Chieh Lin, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 412 days.

(21) Appl. No.: 10/726,670

(22) Filed: Dec. 4, 2003

(65) Prior Publication Data

US 2005/0047924 A1 Mar. 3, 2005

(30) Foreign Application Priority Data

Aug. 26, 2003 (TW) ..... 92123376 A

(51) Int. Cl.
*B41J 2/135* (2006.01)

(52) U.S. Cl. ..... 347/44; 347/56

(58) Field of Classification Search ..... 347/44, 347/46, 55, 68–71, 54; 417/207; 222/386.5, 222/389, 390, 146.2
See application file for complete search history.

(56) References Cited

U.S. PATENT DOCUMENTS 5,339,640 A * 8/1994 Reinke ..... 62/6
5,369,625 A * 11/1994 Gabrielson ..... 367/140
7,062,921 B1 * 6/2006 Jeng et al. ..... 62/6

* cited by examiner

*Primary Examiner*—Juanita D. Stephens
(74) *Attorney, Agent, or Firm*—Troxell Law Office, PLLC

(57) ABSTRACT

A microfluidic pump driven by thermoacoustic effect is mainly composed of a thermoacoustic device, a fluid-storing tank, and at least one microchannel, etc., wherein the thermoacoustic device may convert thermal energy into acoustic energy. Pressure fluctuation and velocity fluctuation with high frequency are generated by the acoustic wave. According to the high amplitude pressure fluctuation, the microfluid with high moving velocity emitted through microchannels. Since there is no movable part arranged in the thermo-acoustic generator. In the meantime, it indirectly drives the working fluid located in the fluid-storing tank by the manner of indirect contact. So the present invention may be applied in the non-conductive fluid so as to greatly extend its field of application. Moreover, the characteristics of the fluid won't be influenced by the heating process as well. The present invention is indeed a microfluid-driving device that has inventiveness and high application value.

12 Claims, 5 Drawing Sheets

MICROFLUIDIC PUMP DRIVEN BY THERMOACOUSTIC EFFECT

FIELD OF THE INVENTION

The invention relates to a microfluidic pump driven by thermoacoustic effect, more particularly, to a microfluidic pump driven by thermoacoustic effect that uses the thermoacoustic effect for converting thermal energy into acoustic energy to generate high-amplitude pressure fluctuation and velocity fluctuation for driving microfluid.

BACKGROUND OF THE INVENTION

Following the rapid development of modern technology, microfluidic pump is widely applied in all kinds of hi-tech field, such as biomedical detection and inkjet printing. The so-called "microfluid driving system" may be further classified as the follows according to its function: micro jet, micro droplet, and microfluidic mixing. Currently, there are many methods by which fluid actuation through microchannels can be achieved, including the direct usage of micropump or thermal bubble pumping, both of which drive microfluid by direct contact. The former, i.e. micropump, is widely applied in biochip and the structure thereof can be further divided into mechanical micropump and electrode-powered micropump, wherein the fabrication of the mechanical micropump is mainly by using the micromachining technique to directly layout built-in movable parts on chips, such as an electrostatically driven diaphragm micropump, which was proposed in U.S. Pat. No. 5,529,465, wherein, the main body thereof comprises four layers of crystalline silicon structure, and the actuation of the pump is completed using the circulation and exchange generated by the intermittent electrostatic interaction between two layers structure that functions in cooperation with two pieces of single-direction passive check valve inside the fluid channel. In addition, U.S. Pat. No. 5,705,018 proposed another micropump having simpler structure, i.e. micromachined peristaltic pump, which is fabricated mainly by implanting pieces of flexible conductive strip sequentially and densely on the inner walls of the microchannels of the chip, thus, when voltage pulse passes over the top of the microchannel, staticelectricity will be generated to sequentially attract the conductive strips to move upwardly to thereby create a peristaltic phenomenon for the microchannel to push the fluid in the microchannel to move forwardly.

On the other hand, the electrode-powered micropump is a kind of non-mechanical micropump without any movable part to be laid out on the chip. Its operating principle may be roughly classified as: electroosmosis (EO), electrohydrodynamics (EHD), and electropulse (EP). For example, U.S. Pat. No. 5,632,876 proposed a combining application of EO and EHD, which is a pumping device in a microchannel mainly comprising two pairs of electrodes inserted into the microchannels of the chip, the pair of electrodes located in the middle are more close to each other and are deepened into the fluid in the microchannels, so that when high voltage is conducted, the two closer electrodes will generate current circuit using the fluid in between, in the meantime, the surrounding fluid will be brought along to move in counter direction of the current to thereby form an EHD pumping effect, that is, the two closer electrodes operated together will form an EHD pump, in addition, another pair of electrodes which is farther to each other touch the microchannel's wall only slightly, thus, when high voltage current is conducted through, the microchannel's wall will be electrically charged, such that the surfaces of the materials where the positive and negative electrodes are located are covered with negative and positive charges, the same time, if the fluid contains negative particles, then they will be attracted and permeate toward the negative electrode which is piled with positive charges, and in the meantime, the fluid will flow toward the negative electrode to form an EO pumping effect, that is, the pair of electrodes that are farther can operate together to form an EO pump. The foregoing U.S. patent applies the two effects, which are EHD and EO, capable of generating two streams flowing in counter directions, and by controlling the raise and fall of the two effects so as to enable the guidance and control technique for microfluid, such as propulsion, repulsion, and stagnation.

In addition, the bubble-based micropump is widely applied in the field of inkjet printing, wherein a voltage pulse is applied to the electric resistance so as to heat and vaporize the ink for generating bubbles in the ink box and further increase the pressure therein, such that the ink may be jetted out from the nozzle of the ink box, moreover, when the voltage pulse is disappeared, the bubbles will disappear subsequently, therefore, the jetting action of ink may be proceed repeatedly by controlling the voltage input into the electric resistance.

Although there are different principles and structures for actuating the aforementioned microfluid driving devices, they are all belonged to the type of driving by direct contact, that is, the fluid to be driven must be heated or be applied with electrodes of different magnitudes. Therefore, there are many limitations unavoidably imposed upon the kinds of fluids that can be used. For example, the microfluid driving device driven by electrodes is only suitable to be used in conductive fluids, but applying electrode in the bimedical detection process may damage the fluid itself that will have affect on the accuracy of the detection. In addition, since the thermal bubble-based micropump directly heats and vaporizes the ink itself, the ink used must have stable thermal property, low conductivity, and low chemical activity, which are the reasons why the price of the ink used in ink-jet machine is so high.

SUMMARY OF THE INVENTION

The main objective of the present invention is to provide a microfluidic pump driven by thermoacoustic effect, comprising thermoacoustic device, fluid-storing tank, and microchannels, wherein the thermoacoustic device is the source generating acoustic wave of high frequency and high acoustic energy, and the microchannels are arranged upon the tank body of the fluid-storing tank that is combined with the thermoacoustic device. By the design of the aforementioned structure, the present invention may apply the acoustic wave, with high frequency and high energy, generated by the thermoacoustic device to drive the working fluid contained in the fluid-storing tank by indirectly contacting manner, such that the driven microfluid may be discharged through the microchannels. Since the microfluid of the present invention is driven indirectly so, compared with the directly driving manners of prior arts that apply electrodes or heat to the working fluids with direct contact, the invention not only may be extensively applied to non-conductive fluids, but also may greatly increase the fields and kinds of applicable fluid.

Another objective of the invention is to provide a microfluidic pump driven by thermoacoustic effect, wherein, by changing the structures and arrangement positions of the fluid-storing tank and microchannels thereon, it is possible to generate different flow patterns, such as: micro jet, micro droplet, and microfluidic mixing, etc.

DETAILED DESCRIPTION OF THE INVENTION

Figure 1:
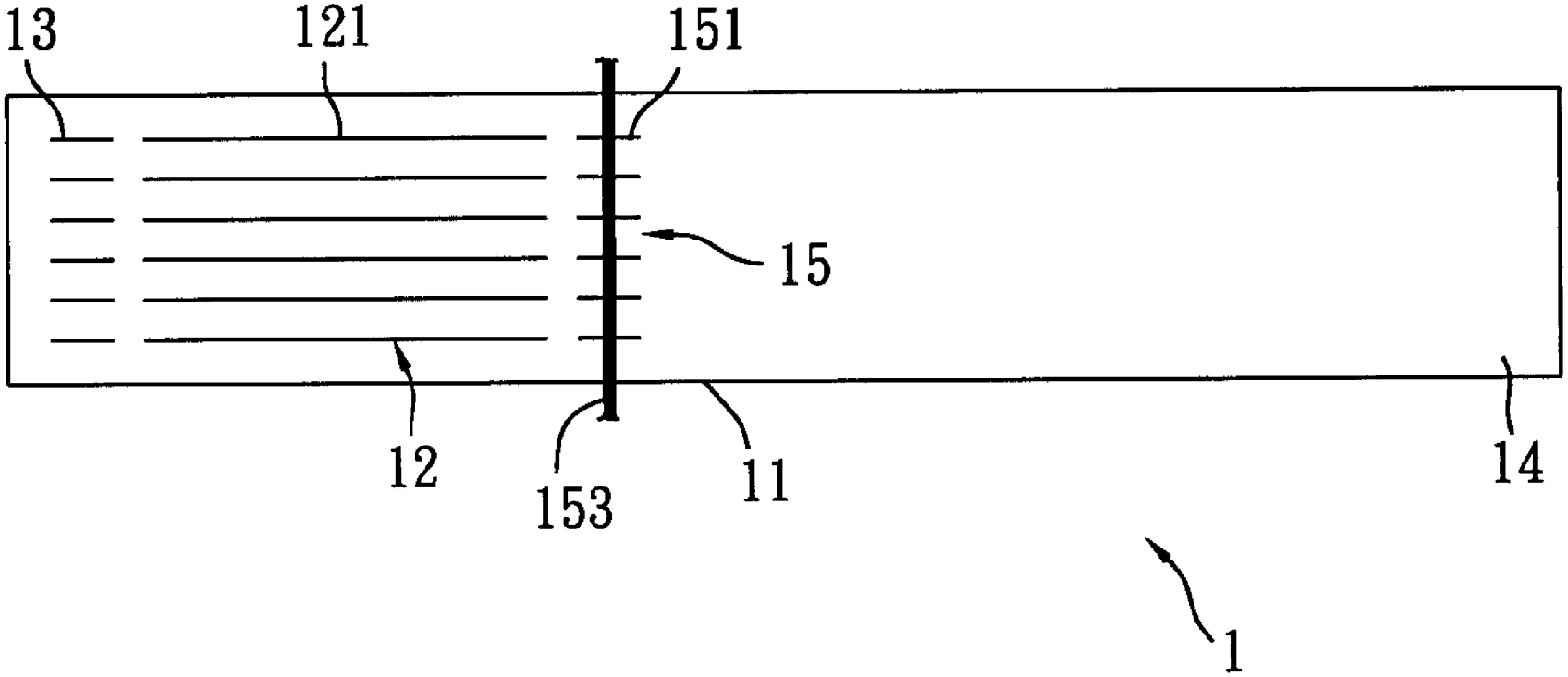
FIG. 1 is a schematic diagram showing a thermoacoustic device.
Figure 2:
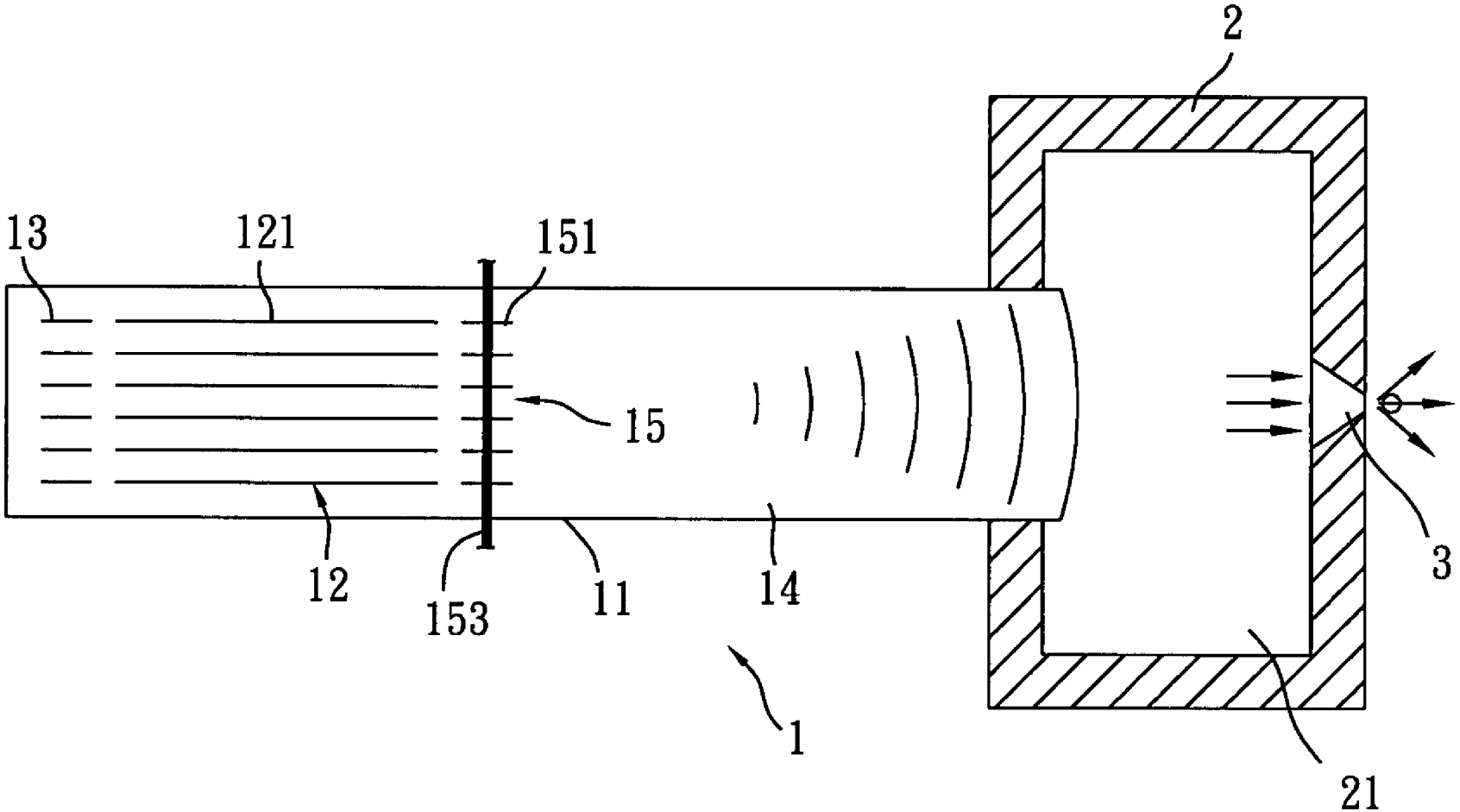
FIG. 2 is a diagram showing a first preferred embodiment of the present invention.

First, as shown in FIG. 1 and FIG. 2, which are a schematic diagram showing a thermoacoustic device and a diagram showing the first preferred embodiment of the present invention. The microfluidic pump driven by thermoacoustic effect disclosed in the present invention comprises a thermoacoustic device 1, a fluid-storing tank 2, and microchannels 3. Wherein, the thermoacoustic device 1 is the source generating acoustic wave of high frequency and high acoustic energy. The microchannels 3 are arranged at the tank body of the fluid-storing tank 2. The fluid-storing tank 2 is combined with the thermoacoustic device 1. By the design of the aforementioned structure, the present invention may apply the acoustic wave of high frequency and high energy generated by the thermoacoustic device 1 to drive the working fluid 21 stored in the fluid-storing tank 2, such that the driven microfluid can be emitted through the microchannels 3. In the present invention, the working fluid 21 stored in the fluid-storing tank 2 is driven indirectly, hence, compared with the direct driving methods of prior arts that apply electrodes or heat to the working fluids with direct contact, the present invention not only can be extensively applied to non-conductive fluids, but also can reduce many limitations imposed upon the working fluids according to prior driving devices, therefore, the present invention may greatly increase the fields and kinds of applicable fluid and may effectively lower the cost.

In the aforementioned structure, the thermoacoustic device 1 further is composed of a resonant tube 1, stack 12, a heater 13, a working gas 14, and at least one heat exchanger 15, etc., as shown in FIG. 1. Wherein, the stack 12, heater 13, working gas 14, and heat exchanger 15 are located inside the resonant tube 1. The heater 13 and heat exchanger 15 are respectively located at two opposite sides of the stack 12. The working principle of the thermoacoustic device 1 is to utilize the conversion between thermal energy and acoustic energy. When the heater 13 located at the left side of the stack 12 heats the working gas 14 such that a temperature gradient between the two sides of the stack 12 is formed. If the temperature gradient is greater than the critical temperature gradient, acoustic wave will be generated. Since the temperature of the working gas is raised, the volume and pressure of the gas parcels are changed. When the gas parcels move to the right, since a temperature gradient exists along the boundary of stack. 12 and the gas parcel, heat will be transferred from gas parcels to the right end of stack 12. Subsequently, the gas parcel will move to the left and absorbs heat from the left of the stack so that a complete thermodynamic cycle is completed. The reciprocation motion and the pressure variation of gas parcels are the cause of forming acoustic wave in the resonant tube 11. The thermoacoustic device 1 has three characteristics: (1) capable of generating acoustic wave with high amplitude of pressure fluctuation; (2) capable of generating velocity fluctuation; (3) capable of interaction between working gas and the solid wall.

Figure 5:
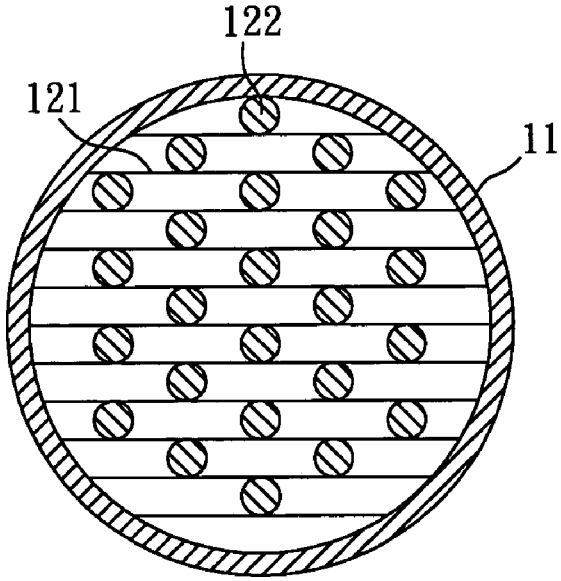
FIG. 5 is a cross-sectional view depicting the lamination of the present invention.

The stack 12 is further composed of a plurality of plates 121 and a plurality of support elements 122 for supporting the plates 121. Wherein, the distance between two adjacent plates 121 is dependent on the working fluid and the working frequency (as shown in FIG. 5).

Figure 6:
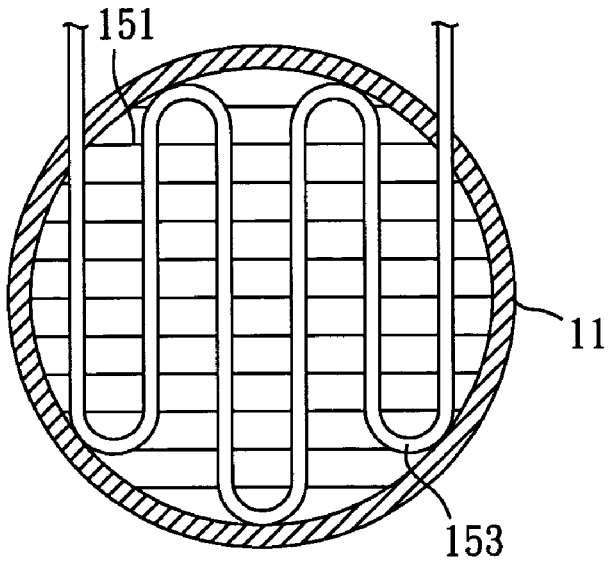
FIG. 6 is a cross-sectional view depicting the heat exchanger of the present invention.

FIG. 6 is a cross-sectional view depicting the heat exchanger of the present invention. The heat exchanger 15 is further composed of plural fins 151 and pipes 153. The heat-dissipating fins 151 are fixed securely at the pipes 153 in parallel way. The pipe 153 may be a straight tube or a bent tube. Moreover, each fin 151 is parallel to the plate 121 of the stack 12.

By changing the structures and arrangement positions of the fluid-storing tank 2 and its microchannels 3, the present invention is capable of generating different flow patterns, such as: micro jet, micro droplet, and microfluidic mixing, etc. FIG. 2 shows a first preferred embodiment of the present invention. Wherein, the fluid-storing tank 2 is arranged at the rear of the thermoacoustic device 1 and by which the thermoacoustic device 1 is capable of generating periodic pressure wave so as to drive the drop-on-demanded microfluid, moreover, the flowing direction of the microfluid is parallel to that of the acoustic wave is transferring. The periodic pressure fluctuation creates the actions of injection and suction that enable a discontinuous microfluid of high frequency is formed, so that a high frequency microdroplet of high quality is made.

Figure 3:
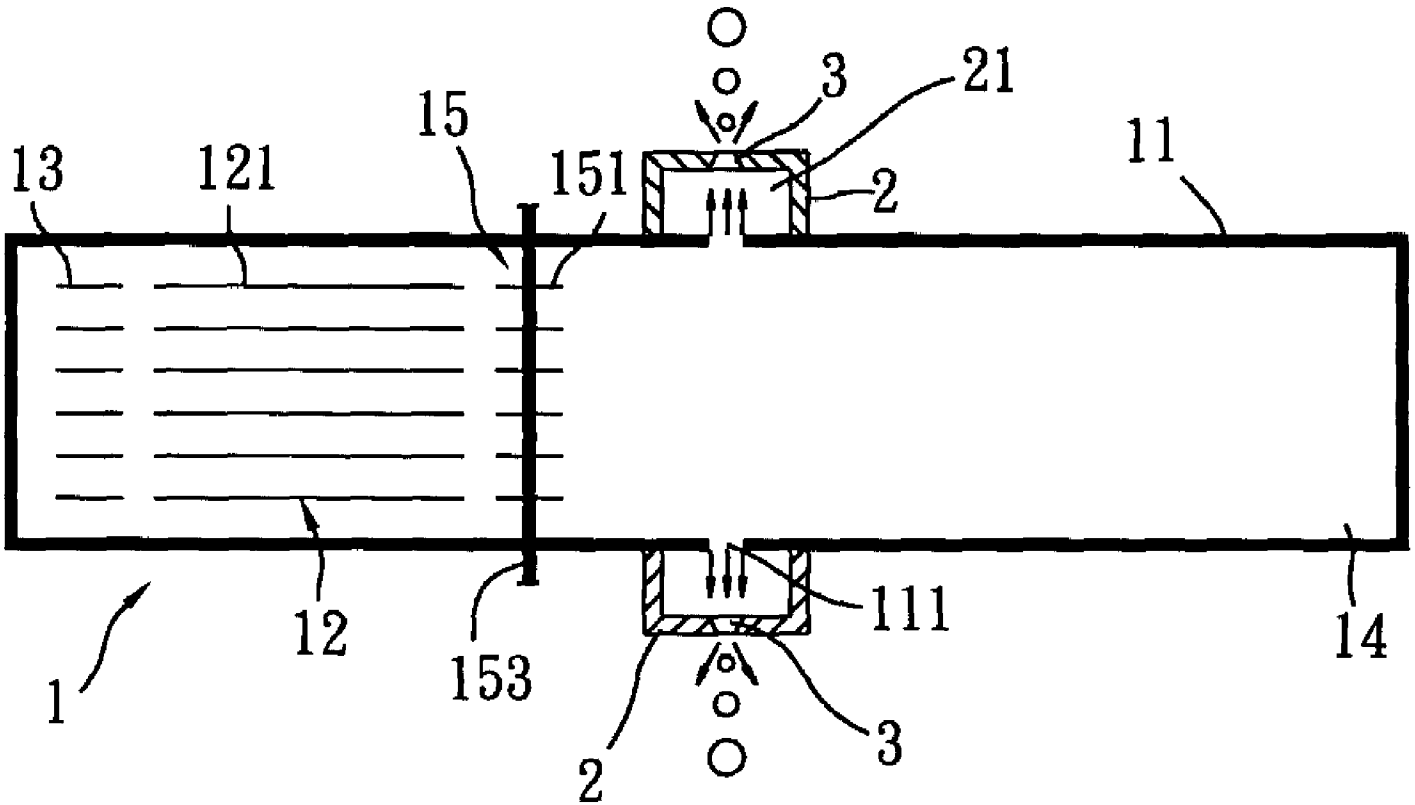
FIG. 3 is a diagram showing a second preferred embodiment of the present invention.

FIG. 3 shows a second preferred embodiment of the present invention. Wherein, the resonant tube wall in the middle section of the thermoacoustic device 1 is near the antinode of pressure wave, that is, holes 111 are arranged at the surrounding of the tube wall of the low temperature section of the stack, while the fluid-storing tank 2 is arranged at the outside of the holes 111. The thermoacoustic device 1 generates periodic pressure fluctuation of high amplitude, and this pressure wave will form a driving force, so the said driving force may directly drive the working fluid 21 in the fluid-storing tank 2 so that the microfluid 21 may be emitted out of the microchannels to form a micro jet. Wherein, the direction of the flow is perpendicular to that of the acoustic wave is transferring.

Figure 4:
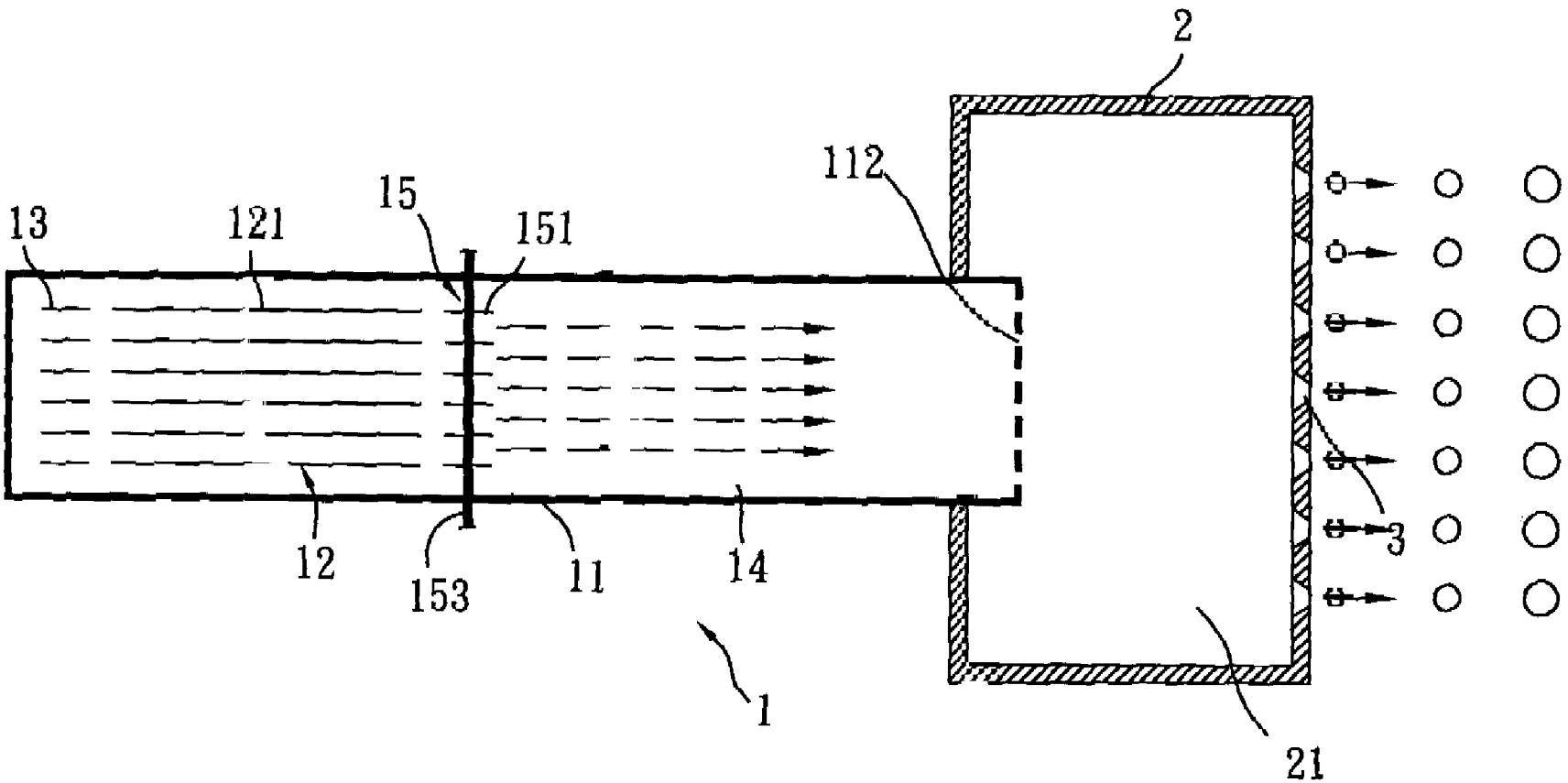
FIG. 4 is a diagram showing a third preferred embodiment of the present invention.

As shown in FIG. 4, a third preferred embodiment of the present invention. The fluid-storing tank 2 arranged with microchannels 3 is located at an end of the resonant tube 11 wall opposite to the heater 13, and at least one flow exit 112 is arranged on the resonant tube 11 wall at the position opposite to the heater 13. Since the major application of the thermoacoustic device 1 is to drive microfluid, the structure of the thermoacoustic device 1 must also be miniaturized. After the thermoacoustic device 1 is miniaturized, the effect of Reynolds stresses will generate acoustic streaming between the wall plate due to the operation of the high fluctuation amplitude of pressure wave. Therefore, in the third preferred embodiment shown in FIG. 4, periodic velocity fluctuation will be generated within the solid wall of the thermoacoustic device 1 to effectively create the fluid driving function of high frequency.

Since the present invention is to convert thermal energy into acoustic energy, and further the acoustic wave is used directly or indirectly for driving the microfluid, comparing with the prior arts that directly heat or apply electrodes onto the working fluid, the present invention not only may prevent the working fluid from generating physical or chemical changes due to the heating process, but also may effectively prevent the working fluid from the changing of fluid properties during the working fluid passing through the electrodes, thus, the present invention can be applied in the field of biomedical detection and a more accurate analysis result will be obtained.

Again, compared with other products, the microfluidic pump driven by thermoacoustic effect has following advantages:

(1) Having high amplitude pressure fluctuation: because of resonant effect, the acoustic energy in the resonant tube 11 will be effectively concentrated, so the amplitude of pressure fluctuation will be greatly enhanced, also, the pressure in the tube will be varied periodically because of the existence of pressure fluctuation, so the working fluid may be pumped and sucked in high frequency such that the present invention can be applied in a drop-on-demand microfluid driving system.

(2) Having high acoustic intensity: currently, thermoacoustic device 1 may generate acoustic wave with acoustic intensity above 1.5 $kW/m^2$. As the acting force converted from acoustic wave and operated on working fluid is proportional to the acoustic intensity, therefore, the present invention can provide a higher pressure head to the microfluid system.

Furthermore, in the structure of the present invention, it is possible to assemble many sets of thermo-acoustic device to provide a more uniform acoustic wave with high energy, such that flow field having more uniformly flow distribution.

In summary, the microfluidic pump driven by thermoacoustic effect according to the present invention is to convert thermal energy into acoustic energy and by which drives microfluid in an indirect/direct manner, and no additional electrodes or direct heating is needed for the fluid. Not only may the present invention be widely applied to other fluidic field without influencing its properties, but also may the manufacture of the present invention be made by micro electromechanical system (MEMS) to reach the purpose of miniaturization. So, the present invention is really a microfluid driving technique of high application value.

What is claimed is:

1. A microfluidic pump driven by thermoacoustic effect, comprising:

a fluid-storing tank;

at least one microchannel, arranged at a tank body of the fluid-storing tank for communicating the fluid-storing tank with outside world;

a thermoacoustic device, further comprising:

a resonant tube, within which stores a working gas and forming a resonant acoustic wave;

at least one stack, arranged in the resonant tube;

a heater, fixed in the resonant tube and located at one side of the stack; at least a heat exchanger, arranged at a side of the stack in the resonant tube opposite to the heater; and wherein, a working microfluid is stored in the fluid-storing tank, and the heater located at the side of the stack heats the working gas such that a temperature gradient greater than a critical temperature gradient between the two sides of the stack is formed, and consequently, the acoustic wave is generated.

2. The microfluidic pump driven by thermoacoustic effect according to claim 1, wherein the microfluid stored in the fluid-storing tank is driven by the acoustic wave generated by the thermoacoustic device, and the driving direction of the pressure fluctuation is parallel to the transmitting direction of the acoustic wave.

3. The microfluidic pump driven by thermoacoustic effect according to claim 2, wherein the pressure fluctuation generated by the thermoacoustic device is capable of causing a volume variation of the fluid-storing tank, and the driving force generated by the volume variation will squeeze the working fluid in the fluid-storing tank to flow through the microchannel.

4. The microfluidic pump driven by thermoacoustic effect according to claim 1, further including a plurality of holes arranged at the resonant tube near an antinode of the pressure fluctuation generated in the thermoacoustic device, which enable the direction of a velocity fluctuation to be perpendicular to the transmitting direction of the acoustic wave, moreover, the fluid-storing tank storing the working fluid is cooperatively arranged at the outside of the holes.

5. The microfluidic pump driven by thermoacoustic effect according to claim 4, wherein the holes capable of generating velocity fluctuation is arranged at any location of the resonant tube of the thermoacoustic device.

6. The microfluidic pump driven by thermoacoustic effect according to claim 1, wherein the acoustic wavedrives the microfluid in the resonant tube in the direction parallel to the transmitting direction of the acoustic wave, and the fluid-storing tank arranged with microchannels is located at an end of the resonant tube wall opposite to the heater, and at least a flow exit is arranged on the resonant tube wall at the position opposite to the heater.

7. The microfluidic pump driven by thermoacoustic effect according to claim 6, wherein the thermoacoustic device is composed of two sets of stacks or more, such that the flow uniformity of the working microfluid is enhanced.

8. The microfluidic pump driven by thermoacoustic effect according to claim 1, wherein the stack is further composed of a plurality of plates and a plurality of support elements supporting the plates.

9. The microfluidic pump driven by thermoacoustic effect according to claim 1, wherein the heat exchanger is further composed of plural fins and pipes, and the fins are arranged fixedly at and parallel to the pipes.

10. The microfluidic pump driven by thermoacoustic effect according to claim 9, wherein the pipe is a straight tube or a bent tube.

11. The microfluidic pump driven by thermoacoustic effect according to claim 9, wherein each fin is parallel to the plate of the stack.

12. The microfluidic pump driven by thermoacoustic effect according to claim 9, wherein the stack is made of materials of low thermo-conductivity.

* * * * *